US008500045B2

(12) United States Patent
Moore

(10) Patent No.: US 8,500,045 B2
(45) Date of Patent: Aug. 6, 2013

(54) PARALLEL CIRCUIT FUEL FILTRATION FOR FUEL INJECTORS

(75) Inventor: Bryan D. Moore, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 708 days.

(21) Appl. No.: 12/505,906

(22) Filed: Jul. 20, 2009

(65) Prior Publication Data

US 2011/0011955 A1 Jan. 20, 2011

(51) Int. Cl.
*B05B 1/30* (2006.01)

(52) U.S. Cl.
USPC ..... 239/585.5; 239/5; 239/462

(58) Field of Classification Search
USPC ..... 239/5, 88–96, 533.2, 533.12, 569, 239/584, 585.1–585.5, 462; 251/129.15, 251/129.21, 127
See application file for complete search history.

(56) References Cited

U.S. PATENT DOCUMENTS 3,829,014 A 8/1974 Davis et al.
4,197,996 A * 4/1980 Giardini ..... 239/87
4,373,671 A * 2/1983 Giardini ..... 239/585.5
4,627,574 A 12/1986 Hofmann
5,360,164 A 11/1994 Pape et al.
5,423,489 A 6/1995 Wood
5,641,126 A 6/1997 Nally et al.
5,967,424 A 10/1999 Bonnah, II
6,015,103 A 1/2000 Kotkowicz
6,186,420 B1 2/2001 Hofmann
6,192,870 B1 2/2001 Lambeth
6,328,232 B1 12/2001 Haltiner, Jr. et al.
6,663,026 B2 12/2003 MacFarland
7,093,582 B2 8/2006 Magel et al.
2003/0234006 A1 * 12/2003 Saito et al. ..... 123/467

* cited by examiner

*Primary Examiner* — Davis Hwu

(74) *Attorney, Agent, or Firm* — Carl E. Meyers; Liell & McNeil

(57) ABSTRACT

A fuel injector that comprises a parallel circuit fuel filtration circuit providing filtered fuel to the control valve. Specifically, a fuel filter is positioned inside the injector within the passage leading to the control valve. Debris is removed from the fuel and filtered fuel is allowed to pass through to the control valve. Unfiltered fuel may be purged from the fuel injector during injection. Alternatively, unfiltered fuel may be removed from the injector via the drain.

12 Claims, 3 Drawing Sheets

PARALLEL CIRCUIT FUEL FILTRATION FOR FUEL INJECTORS

TECHNICAL FIELD

The present disclosure relates to a fuel filtration device and more specifically, a fuel injector with a parallel circuit fuel filtration circuit.

BACKGROUND

Increased emission standards have lead fuel injector manufacturers to operate at higher injection pressures. For example, typical common rail injectors are now injecting fuel at pressures between 250 and 300 MPa. In order to reach these higher injection pressures, control valves within fuel injectors must operate with precision in an environment free from fuel debris and contaminants. Thus, it is increasingly important fuel to be filtered before being delivered to control valves.

Control valves within injectors perform a myriad of tasks related to injection. In order to repeatedly perform these tasks, control valves are assembled to exacting standards. These standards make control valves susceptible to and more affected by damage from debris that may be contained within the fuel supplied thereto. It has been recognized that debris from fuel damages control valves much more than any other valves (e.g., check valves) within the injector. Damaged control valves ultimately lead to injector failure.

Previous attempts to filter fuel within an injector have always been in "series." In other words, said attempts have stubbornly sought to filter all fuel delivered to the injector and ultimately both the control and check valves. This has typically been done by inserting a filter at or near the high-pressure fuel inlet of the injector. Inserting filter at this point ultimately fails and allows debris into the injector for at least two reasons. First, by attempting to filter all high-pressure fuel provided to the injector, the limits of the filter efficiency dictate that at least a small percentage of debris will ultimately get through the filter and potentially have access to the control valve. Secondly, when a filter in series becomes inundated with debris such that the filter can catch no more debris, a pressure drop across the filter occurs. The increasing pressure behind the filter eventually overcomes the blockages and pushes debris through the filter; into the injector; and ultimately to the sensitive control valve.

By counter-intuitively realizing that not all valves need the same level of protection by the filter, the present disclosure seeks primarily to protect the sensitive control valve. It does this by filtering the fuel within the injector in "parallel" as opposed to in "series." In other words, fuel delivered to the control valve is filtered while the fuel provided to the check valve may or may not be filtered. The filter in the present disclosure is positioned adjacent the control valve and downstream of the fuel supply inlet. In so doing, the disclosed fuel injector is directed to overcoming one or more of the problems set forth above.

SUMMARY OF THE INVENTION

In one embodiment the fuel injector has an injector body, a control valve assembly positioned within the injector body, a check valve positioned within the injector body, a fuel supply line with an inlet, a first passage in fluid communication with the control valve assembly, and a second passage in fluid communication with the check valve, and a filter positioned within the first passage of the fuel supply line.

In another embodiment a fuel system has a fuel supply, a pump fluidly connected to the fuel supply, at least one fuel injector fluidly connected to the pump and wherein the at least one fuel injector has an injector body, a control valve assembly positioned within the injector body, a check valve positioned within the injector body, a fuel supply line with an inlet, a first passage in fluid communication with the control valve assembly, and a second passage in fluid communication with the check valve, and a filter positioned within the first passage of the fuel supply line.

In another embodiment a method of filtering fuel having the steps of supplying a fuel injector that has an injector body, a control valve assembly positioned within the injector body, a check valve positioned within the injector body, a fuel supply line with an inlet, a first passage in fluid communication with the control valve assembly, and a second passage in fluid communication with the check valve, and a filter positioned within the first passage of the fuel supply line; delivering fuel to the fuel injector via the inlet of the fuel supply line; diverting a portion of the fuel within the fuel supply line to the first passage, and another portion of fuel to the second passage; and filtering the fuel delivered to the control valve assembly.

DETAILED DESCRIPTION

Figure 1:
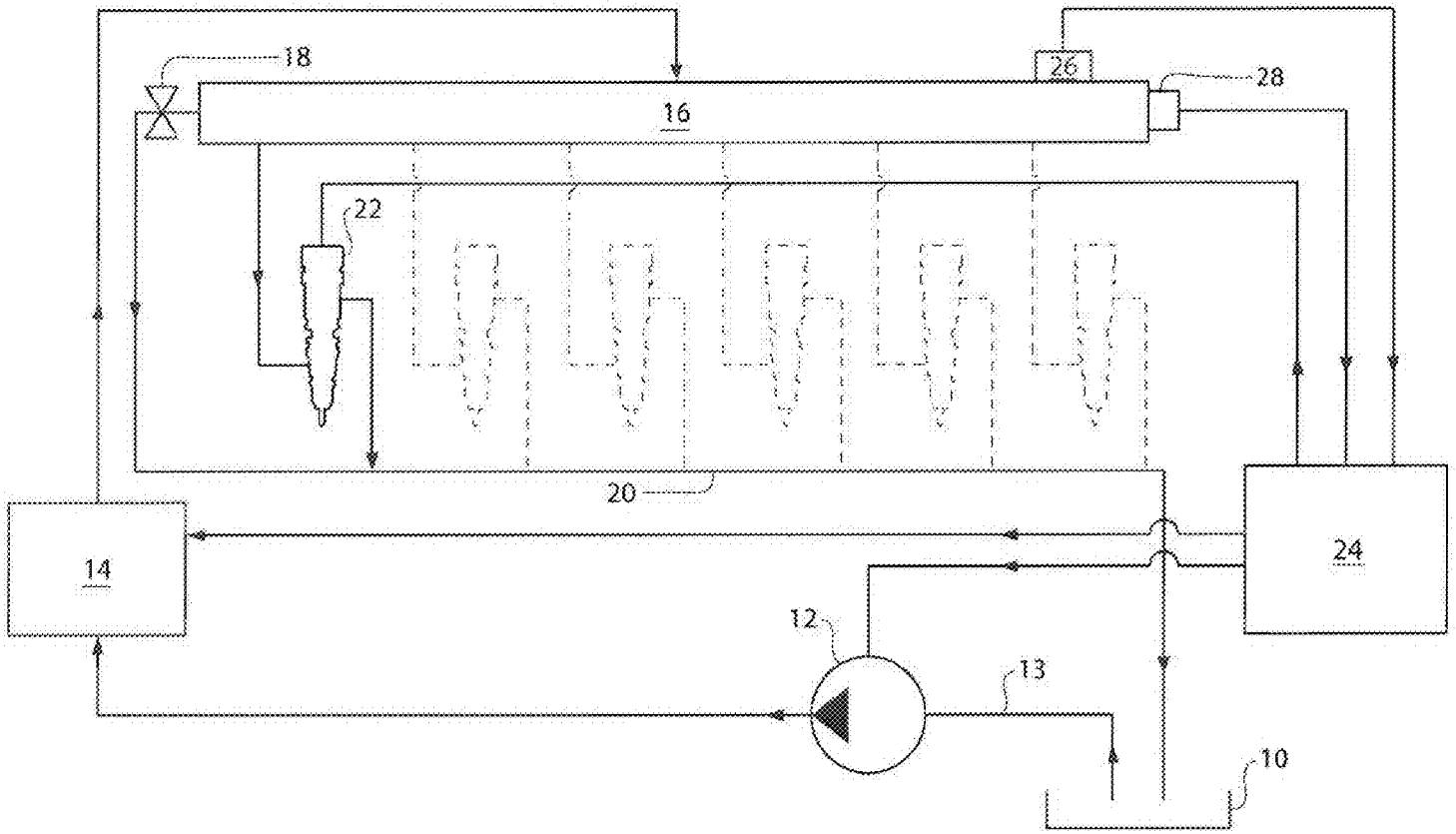
FIG. 1 is a diagrammatic schematic of a fuel system using a common rail fuel injector.

Referring to FIG. 1, a fuel system utilizing a common rail fuel injector 22 is shown. A reservoir 10 contains fuel at an ambient pressure. A transfer pump 12 draws low-pressure fuel through fuel supply line 13 and provides it to high-pressure pump 14. High-pressure pump 14 then pressurizes the fuel to desired fuel injection pressure levels and delivers the fuel to the fuel rail 16. The pressure in fuel rail 16 is controlled in part by safety valve 18, which spills fuel to the fuel return line 20 if the pressure in the rail 16 is above a desired pressure. The fuel return line 20 returns fuel to low pressure reservoir 10.

Fuel injector 22 draws fuel from rail 16 and injects it into a combustion cylinder of the engine (not shown). Fuel not injected by injector 22 is spilled to fuel return line 20. Electronic Control Module (ECM) 24 provides general control for the system. ECM 24 receives various input signals, such as from pressure sensor 26 and a temperature sensor 28 connected to fuel rail 16, to determine operational conditions. ECM 24 then sends out various control signals to various components including the transfer pump 12, high-pressure pump 14, and fuel injector 22.

Figure 2:
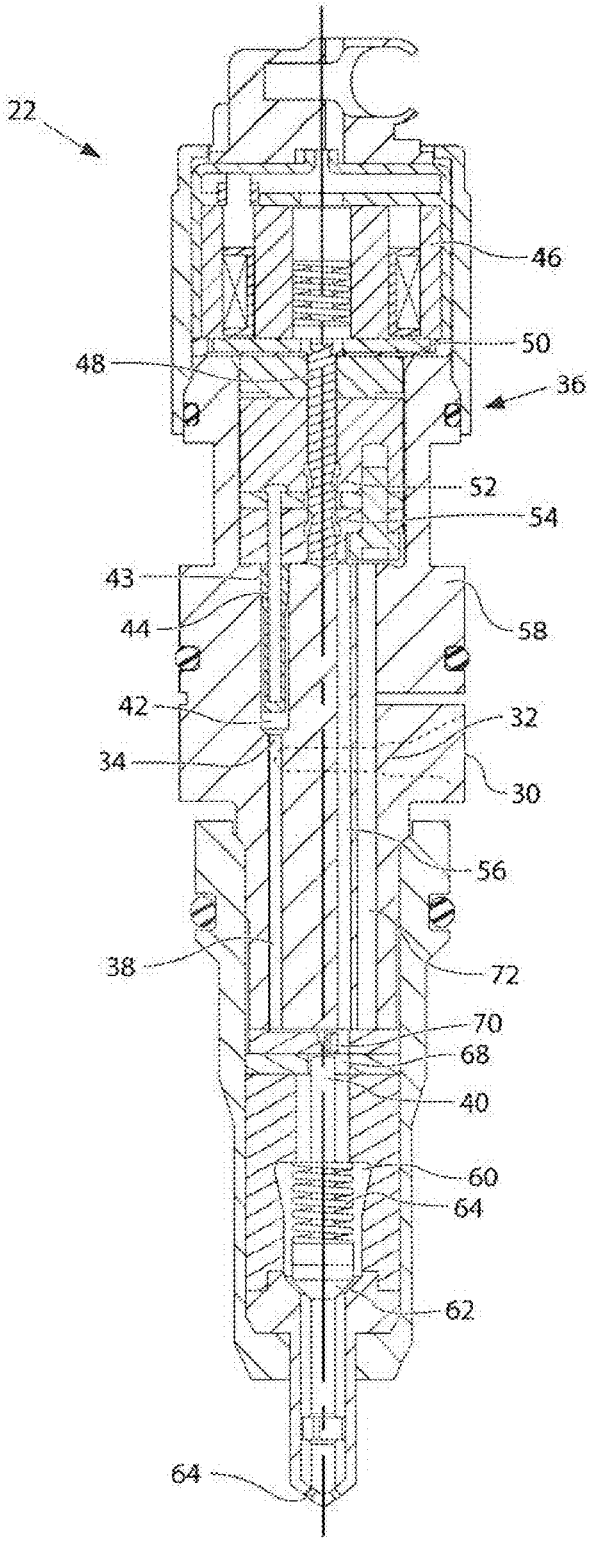
FIG. 2 is a diagrammatic cross section of a fuel injector according to one embodiment of the present disclosure.
Figure 3:
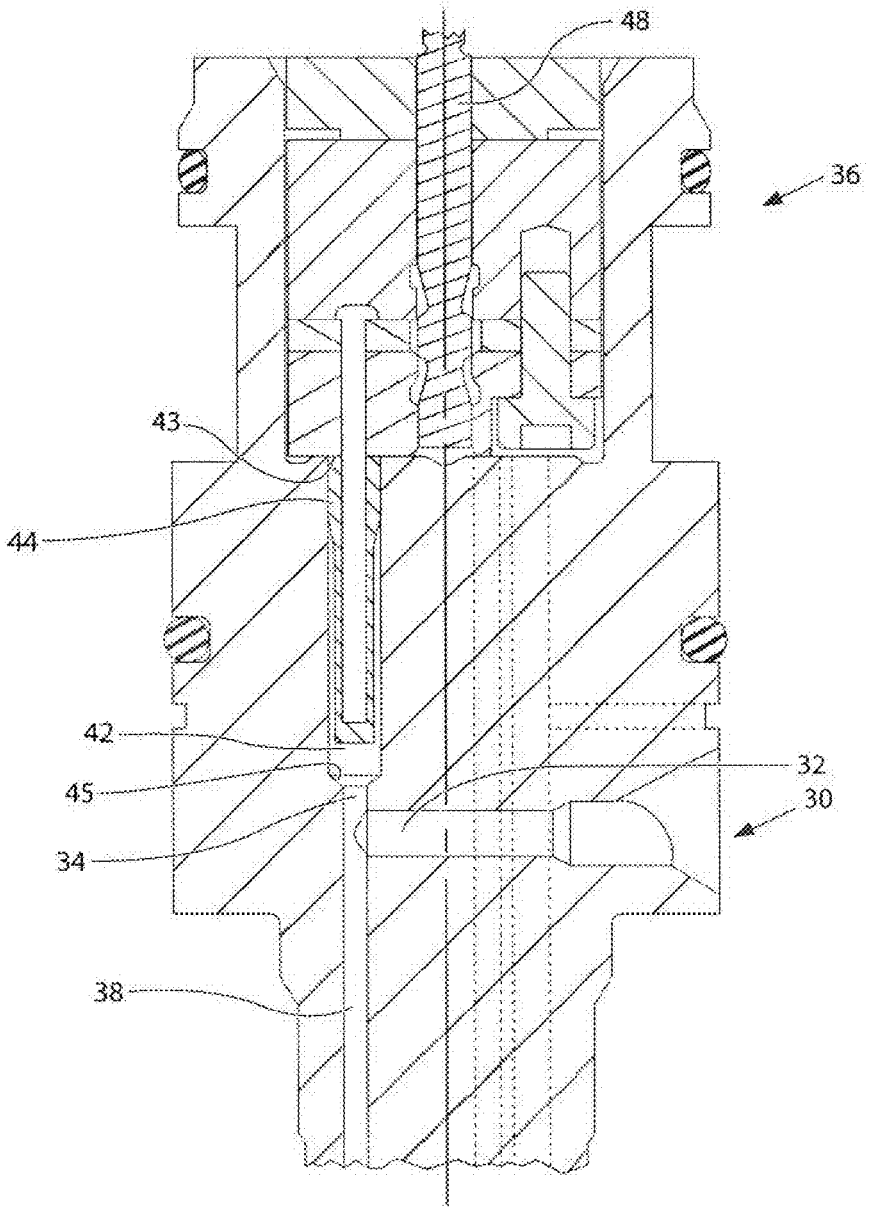
FIG. 3 is a detail of the diagrammatic cross section of a fuel injector according to one embodiment of the present disclosure.

Reference is now made to FIGS. 2 and 3. High-pressure fuel enters the injector through high-pressure supply inlet 30 and travels through a fuel supply passage 32. The fuel supply line has a first passage 34 that leads to a control valve assembly 36 and a second passage/check control cavity line 38 that leads to a check control cavity 40. The first passage may also include a fuel filter chamber 42 positioned within the first passage 34 and adjacent the control valve assembly 36. The fuel filter chamber 42 may have a first shoulder 43 adjacent the control valve assembly 36, and a second shoulder 45 within the first passage 34 but distal the control valve assembly 36. Disposed within the fuel filter chamber 42 is a fuel filter 44. The fuel filter 44 may be installed within the fuel filter chamber 42 by press fitting or any other installation means recognized by those skilled in the art. The fuel filter 44 depicted in FIGS. 2 and 3 is a screen filter. However, as recognized by those skilled in the art, fuel filter 44 may be microfiltration device of any suitable design. For example, fuel filter 44 may be a screen filter, an edge filter, a media filter, or any other type of filter device.

Control valve assembly 36 includes an electrical actuator, such as a piezo or a solenoid 46 (as illustrated in FIGS. 2 and 3). Valve member 48 is movable in response to electrical actuator movement. Solenoid 46 controls the position of armature 50, which attached to valve member 48. Valve member 48 moves between upper seat 52 and lower seat 54 to control the flow of filtered fuel from the first passage 34 of the fuel supply line 32 to check line 56. Although control valve assembly 36 is shown as a poppet valve, other valve types including spool valves, or combinations of various types of valves, etc., could be used.

High pressure fuel in check line 56 travels through body 58 to fuel cavity 60 where it acts upon check valve 62 to push it in an upward direction against the biasing of check spring 64. When check 62 moves upward, fuel exits injector 22 through at least one tip orifice 66.

The opening and closing of check valve 62 is controlled in part by the presence of high pressure fuel in check line 56 and by the valve opening pressure created by the check spring 64. Additionally, a check control cavity 40 exists on top of the check valve 62, and specifically on top of the upper portion 68 of check valve 62, to control the opening of check valve 62. When the top surface 70 of the upper portion 68 is exposed to pressure in check control cavity 40, a force is exerted on check valve 62 biasing it in a closed position. The area of the top surface 70 is generally larger than the area of the check valve 62 exposed to fluid pressure in fuel cavity 60, thereby biasing check valve 62 in the closed position. It should be noted that various check designs are possible. As shown in FIG. 2, a single piece check can be used. Alternatively, a multiple piece check (not shown) could be used. Further, a check piston (not shown) could be implemented.

Pressurized fluid is provided to the check control cavity 40 through check control cavity line 56. Check control cavity 40 is always fluidly connected to low-pressure drain line 72. Focusing particularly on control valve assembly 36, the actuation of control valve assembly 36 controls when injector 22 will inject. Specifically, control valve assembly 36 controls the flow of filtered high-pressure fuel from the first passage 34 of the fuel supply line 32 to check line 56. Further it controls the venting of check line 56 and fuel cavity 60 when injection is over allowing check spring 64 to push check 62 closed.

Industrial Applicability

High-pressure fuel enters the fuel injector through the high-pressure fuel supply inlet 30. At least a portion of the fuel delivered to the fuel supply inlet 30 is delivered through the fuel supply line 32 to the first passage 34 and the fuel filter chamber 42 and through the fuel filter 44 to control valve assembly 36. In the non-energized state of the control valve assembly 36, flow is blocked thereto. In this condition the injector 22 is in a non-injectable mode. When high-pressure fuel to be delivered to the control valve assembly 36 is blocked, it then seeks to travel through the second passage/check control cavity line 38 to check control cavity 40 and low pressure drain 72. It should be noted that in this condition, both check line 56, fuel cavity 60, check control cavity line 38 and check control cavity 40 are all fluidly connected to low pressure drain 72 and subsequently fuel reservoir 10.

When injection is desired, control valve assembly 36 is actuated. Specifically, solenoid 46 is energized, thereby pulling up armature 50. As armature 50 pulls up, valve member 48 is pulled off the lower seat 54. Those skilled in the art will recognize that the control valve could be equipped with a piezo stack actuator. As soon as valve member 48 reaches the upper seat 52, pressurized filtered fuel from the first passage 34 of the fuel supply line 32 is fluidly connected to check line 56. Further, check control cavity 40 is allowed to drain to low pressure drain line 72 thereby removing pressure in the check control cavity 40 and allowing fuel pressure in fuel cavity 60 to push check valve 62 up against check spring 64 and inject into the cylinder (not shown). It should be noted that orifice 66 provides a flow restriction in a low-pressure drain line 72. Low pressure drain line 72 is always open to reservoir 10, therefore as soon as pressurized flow decreases enough that the flow can move through the orifice 66, the pressure in check control cavity line 38, can drain to low pressure.

Once it is desirable to stop injection, control valve assembly 36 is de-energized allowing armature 50 back down to its original position thereby moving valve member 48 from the upper seat 52 to lower seat 54. Finally, pressure decreases in fuel cavity 60, check line 56, check control cavity 40 and check control cavity line 38 to low pressure through low-pressure drain 72.

The above description is intended for illustration purposes only and is not intended to limit the scope of the present disclosure in any way. Thus, those who are skilled in the art will appreciate the various modifications that can be made in the illustrated embodiments without departing from the spirit and scope of the present disclosure, which is defined in the terms of the claims set forth below.

I claim:

1. A fuel injector comprising:

an injector body;

a control valve assembly positioned within the injector body;

a check valve positioned within the injector body;

a fuel supply line with an inlet, a first passage in fluid communication with the control valve assembly, and a second passage, which is in parallel with the first passage, in fluid communication with the check valve;

a filter positioned within the first passage of the fuel supply line; and wherein the first passage and the second passage are arranged such that fuel within the first passage but not the second passage is filtered by the filter.

2. The fuel injector of claim 1, wherein the filter is positioned within a filter chamber having a first shoulder adjacent the control valve assembly, and a second shoulder within the first passage but distal the control valve assembly.

3. The fuel injector of claim 2, wherein the filter is press fit within the filter chamber.

4. The fuel injector of claim 3, wherein the filter is selected from the group comprising screen filters, edge filters, and media filters.

5. A fuel system comprising:

a fuel supply;

a pump fluidly connected to the fuel supply;

at least one fuel injector fluidly connected to the pump and wherein the at least one fuel injector further comprises:

an injector body;

a control valve assembly positioned within the injector body;

a check valve positioned within the injector body;

a fuel supply line with an inlet, a first passage in fluid communication with the control valve assembly, and a second passage, which is in parallel with the first passage, in fluid communication with the check valve; and a filter positioned within the first passage of the fuel supply line; and wherein the first passage and the second passage are arranged such that fuel within the first passage but not the second passage is filtered by the filter.

6. The fuel system of claim 5, wherein the filter is positioned within a filter chamber having a first shoulder adjacent the control valve assembly, and a second shoulder within the first passage but distal the control valve assembly.

7. The fuel system of claim 6, wherein the filter is press fit within the filter chamber.

8. The fuel system of claim 7, wherein the filter is selected from the group comprising screen filters, edge filters, and media filters.

9. A method of filtering fuel comprising the steps of:

supplying a fuel injector comprising;

an injector body;

a control valve assembly positioned within the injector body;

a check valve positioned within the injector body;

a fuel supply line with an inlet, a first passage in fluid communication with the control valve assembly, and a second passage, which is in parallel with the first passage, in fluid communication with the check valve; and a filter positioned within the first passage of the fuel supply line;

delivering fuel to the fuel injector via the inlet of the fuel supply line;

diverting a portion of the fuel within the fuel supply line to the first passage but not the second passage, and another portion of fuel to the second passage but not the first passage; and filtering the fuel delivered to the control valve assembly.

10. The method of claim 9, wherein the filter is positioned within a filter chamber having a first shoulder adjacent the control valve assembly, and a second shoulder within the first passage but distal the control valve assembly.

11. The method of claim 10, wherein the filter is press fit within the filter chamber.

12. The method of claim 11, wherein the filter is selected from the group comprising screen filters, edge filters, and media filters.

* * * * *